United States Patent [19]

Greenlee et al.

[11] Patent Number: 4,583,590

[45] Date of Patent: Apr. 22, 1986

[54] SLIP RELEASING APPARATUS

[75] Inventors: Donald R. Greenlee, Cedar Hill; David G. Dearing, Duncanville, both of Tex.; Andrew J. Tucker, Tulsa, Okla.

[73] Assignee: Dresser Industries, Inc., Dallas, Tex.

[21] Appl. No.: 703,797

[22] Filed: Feb. 21, 1985

[51] Int. Cl.[4] ..... E21B 23/00

[52] U.S. Cl. ..... 166/216; 166/140

[58] Field of Search ..... 166/216, 217, 214, 138, 166/139, 140, 206

[56] References Cited

U.S. PATENT DOCUMENTS

| | | | |
|---|---|---|---|
| 2,631,670 | 3/1953 | Armentrout | 166/208 |
| 3,548,936 | 12/1970 | Kilgore et al. | 166/216 |
| 3,779,314 | 12/1973 | Read | 166/216 |
| 3,818,988 | 6/1974 | Read | 166/216 |
| 4,022,274 | 5/1977 | Jett | 166/138 X |
| 4,488,595 | 12/1984 | Akkerman | 166/206 |
| 4,498,534 | 2/1985 | Lindsey, Jr. | 166/208 |

*Primary Examiner*—James A. Leppink
*Assistant Examiner*—Hoang C. Dang

[57] ABSTRACT

The slip releasing apparatus described herein includes a unitary slip member having wall engaging teeth located in diagonally opposite upper and lower ends and carries a pair of releasing pins mounted therein that project inwardly therefrom. The pins are disposed in recesses or holes formed in a slip carrier member that extends through the slip member. The recesses are configured in the carrier member so that an upward pull on the carrier member moves a release surface onto the carrier member into engagement with the pins in the slip member to cause pivotal or rotational movement of the slip member about a fulcrum formed by the engagement between the teeth on the lower end of this slip member and the pipe in which the slip member is run.

7 Claims, 4 Drawing Figures

SLIP RELEASING APPARATUS

BACKGROUND OF THE INVENTION

This invention relates generally to tools for use in well bores and the like. More particularly, but not by way of limitation, this invention relates to an improved slip release apparatus for use with a packer that is disposed in a well bore.

Well tools slips of the type to which the present invention appertains are illustrated in U.S. Pat. No. 3,548,936, issued Dec. 22, 1970 to M. D. Kilgore et al. The slips referred to, are of unitary construction and maybe described as being generally tubular or cylindrical. The slips are provided with wall engaging or gripping teeth on diagonally opposite ends thereof which ends are separated by a distance that is greater than the diameter of the pipe or well in which the tool is to be used. Upon pivotal movement of such slips about the tool, the wall engaging teeth are moved into engagement with the well bore wall and become firmly embedded therein. To release such slips in the event that the tool is to be removed from the well bore is to be or moved therein, the U.S. Pat. No. 3,548,936 discloses the use of a lug or lugs carried by the slip carrier which are moved into engagement with a shoulder formed adjacent to the periphery of such slips and an upward pull is exerted thereon to rotate the slips from the set position into the unset or retracted position.

In the current designs, the force or pull is exerted directly upwardly into the upper teeth of the slip. In order to move one of the slips to the unset position, the metal of the well pipe or of the slip teeth must be sheared. Shearing of either requires a great deal of force.

In an effort to alleviate the amount of force required for release, a modified form of the slip releasing mechanism is illustrated in U.S. Pat. No. 3,379,314, which issued on Dec. 18, 1973 to N. W. Reed. The releasing apparatus described therein illustrates the use of a dog carried by the releasing lug which extends upwardly into a slot in the slip adjacent to the upper teeth. Upon engagement of the dog with well bore wall and with the slip, the force imparted to the slip tends to pivot the slip and thus reduce the shearing action previously described.

The foregoing methods of releasing the slip have word satisfactorily, but each requires a substantial amount of force.

SUMMARY OF THE INVENTION

An object of this invention is to provide an improved releasing mechanism for unitary slips that is simple to manufacture, requires no extra moving parts, and that substantially reduces the amount of force necessary to unseat or release the unitary slips.

Accordingly, this invention provides an improved slip releasing apparatus for packers and the like that is used in pipes, well bores and the like which comprises a unitary slip member pivotal between set and unset positions. The slip member is of generally cylindrical configuration and includes wall engaging teeth on an outer surface thereon. The teeth are located on generally diagonally opposite portions adjacent to the upper and lower ends of the slip. Diametrically opposed releasing pins are mounted in the slip adjacent to the upper end and project inwardly therefrom. An elongated, tubular slip carrier member extends through the slip and is movable relative thereto. The carrier member has a pair of releasing recesses located therein for receiving the pins. The recesses form releasing surfaces in the carrier member that engage the pins and pivot the slip when the carrier is moved in a direction to move the slip toward the unset position.

BRIEF DESCRIPTION OF THE DRAWING

The foregoing and additional objects and advantages of the invention will become more apparent as the following detailed description is read in conjunction with the accompanying drawing, wherein like reference characters denote like parts in all views and wherein.

DETAILED DESCRIPTION OF THE PREFERRED EMBODIMENT

Figure 1:
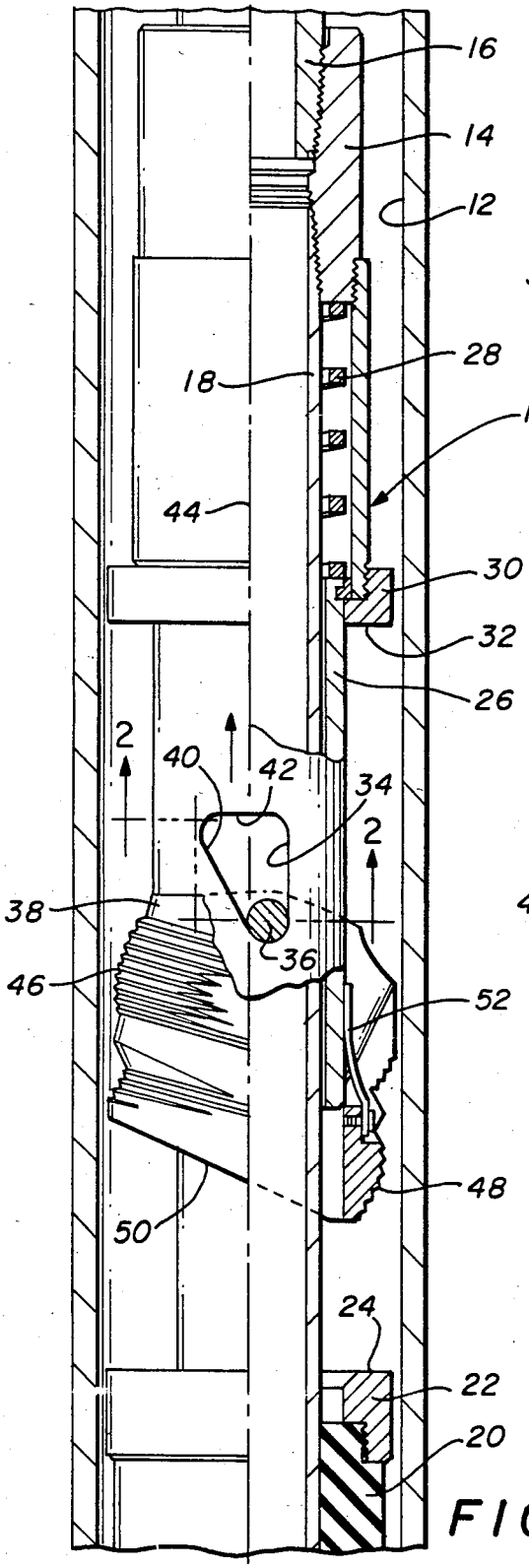
FIG. 1 is a view, partly in elevation and partly in cross-section, of a slip incorporating releasing apparatus constructed in accordance with the invention.
Figure 2:
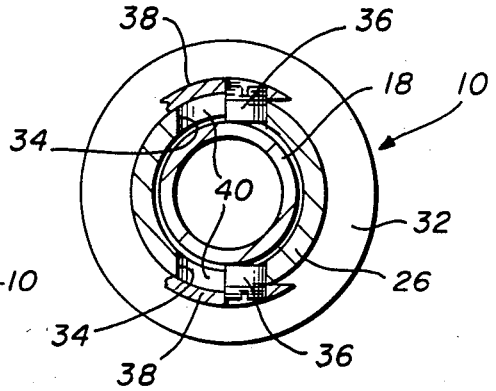
FIG. 2 is a transverse cross section taken generally along the line 2—2 of FIG. 1.

Referring to the drawing and to FIG. 1 in particular, shown therein and generally designated by the reference character 10 is a portion of a well packer that is disposed in a pipe 12. The well packer 10 includes a running and setting assembly 14 that is connected at its upper end to a tubing string 16 utilized to run the packer 10 into the pipe 12. A packer mandrel 18 extends through the packer 10 and carries near its lower end and as illustrated in FIG. 1, a deformable packing member 20 having a thimble 22 located on its upper end. The thimble 22 forms an upwardly facing abutment or shoulder 24 for purposes that will become apparent hereinafter.

A tubular slip carrier 26 encircles the mandrel 18 and has its upper end disposed within the setting apparatus 14. A spring 28 biases the slip carrier 26 toward the position illustrated in FIG. 1. The lower end of the setting apparatus 14 includes an annular member 30 forming a downwardly facing surface 32 which is also provided for purposes that will become more apparent hereinafter.

The slip carrier 26 is provided with a pair of diametrically opposed and mirror image releasing holes or recesses 34 for receiving releasing pins 36. The pins 36 are mounted in and project inwardly of a unitary gripping slip 38.

Each of the recesses 34 is of generally triangular configuration and each forms a release surface 40 on the slip carrier 26 that is the hypotenuse of a triangle and forms a triangle base 42. The length of the bases 42 must be adequate to permit the pins 36 to move sufficiently to allow the slip 38 to move between set and unset positions. It will also be noted that the recesses 34 traverse the longitudinal axis 44 of the slip carrier 26.

The slip 38, as previously mentioned, is generally cylindrical in configuration, is formed from a unitary member. The slip 38 includes upper gripping teeth 46 formed on the upper exterior end thereof and diagonally opposed lower teeth 48 formed on the lower exterior end of the slip 38. It will be noted that the lower end 50 of the slip 38 extends at an angle relative to the axis 44 when the slip is in the unset position as shown in FIG. 1. (A portion of the slip has been removed in FIG. 1 so that one of the recess 34 in the carrier 26 can be seen with the pin 36 disposed therein.) The slip 38 is also provided with a leaf spring 52 that is in engagement with the exterior of the slip carrier 26 and biases the slip 38 toward the retracted or unset position as illustrated in FIG. 1.

Figure 3:
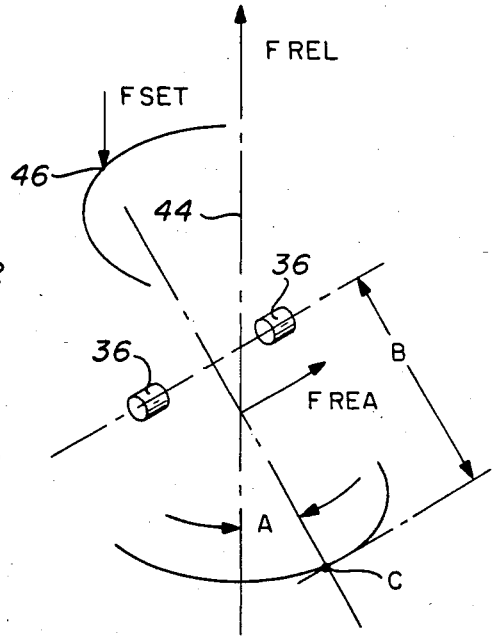
FIG. 3 is a view illustrating the various angles, movement arms and forces involved in the releasing apparatus that is constructed in accordance with the invention.
Figure 4:
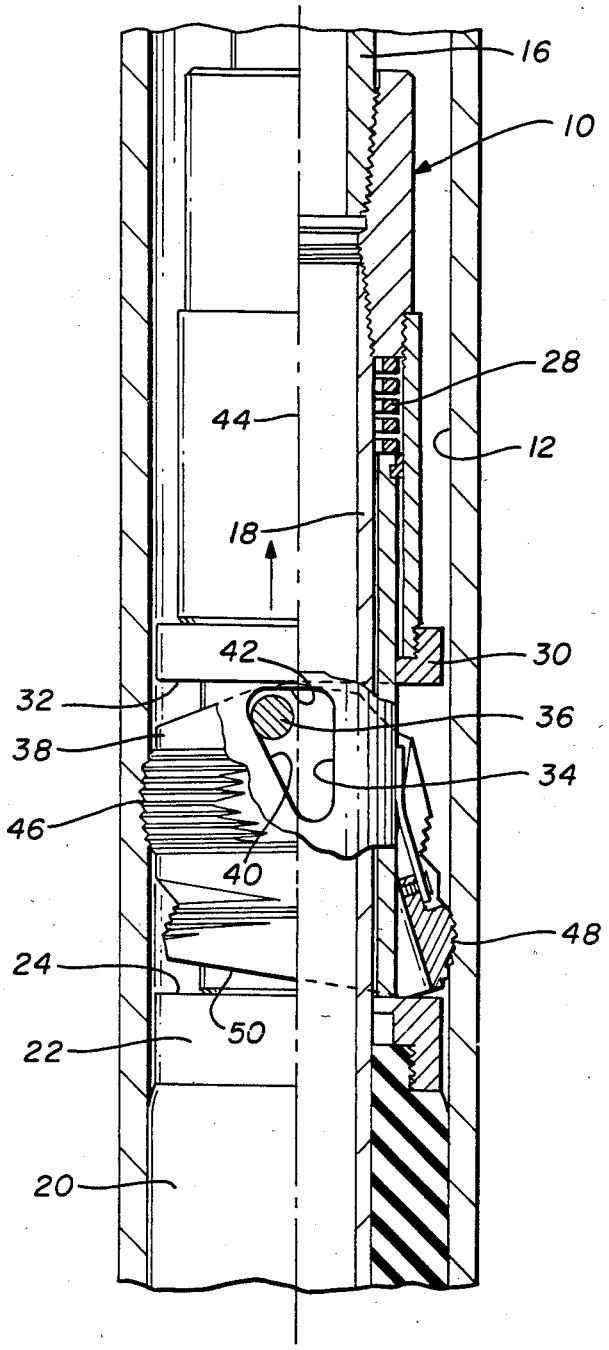
FIG. 4 is a view similar to FIG. 1, but illustrating the slip in the set condition in the well bore.

When in the set position as shown in FIG. 4, the pins 36 are located in the slip 38 at the maximum distance B from the engagement of the lower teeth 48 with the pipe 12. This distance B is shown in FIG. 3 and forms a moment arm through which the releasing force acts. It should also be pointed out that the slip 38 is not pivotally mounted on the slip carrier 26, and thus is somewhat free to move relative to the slip carrier 26, except as restricted by the pins 36.

OPERATION OF THE PREFERRED EMBODIMENT

FIG. 1 illustrates the position of the slip 38 on the tool 10 as the tool is being lowered into the pipe 12, which would normally be disposed in a well bore (not shown). As illustrated therein, the slip 38 is located on the slip carrier 26 in the unset or retracted position so that the teeth 46 and 48 thereon are not engaging the pipe 12. Upon reaching the desired location in the well bore, manipulation of the tool 10 is accomplished in a manner well known in the art, to cause the annular member 30 to move toward the packer thimble 22.

FIG. 4 illustrates the condition of the tool 10 upon setting of the packing element 20 that is, upon its deformation into sealing engagement between the packer mandrel 18 and the interior of the pipe 12. It will also be noted that the upwardly facing shoulder 24 on the thimble 22 is in engagement with the angular lower surface 50 on the slip 38. The contact between the shoulder 24 and the surface 50 causes the slip 38 to rotate or pivot relative to the slip carrier 26 moving the lower teeth 48 into engagement with the pipe 12 and also moving the upper teeth 46 into engagement with the pipe 12. The vertical length of the recesses 34 permits the slip carrier 26 to arrive at the position illustrated in FIG. 4 wherein the downwardly facing surface 32 on the annular member 30 and the shoulder 24 on the thimble 22 engage the ends of the slip 38, causing it to pivot into the set position.

As illustrated in FIG. 4, the pins 36 have moved upwardly in the recesses 34 to the position near the base 42 of the recess 34. At this point, the pins 36 are in a position relative to the lower engagement of the lower teeth 48 with the pipe 12 to describe the angle A illustrated in FIG. 3. Due to the configuration of the slip 38, the engagement between the lower teeth 48 and the pipe 12 forms a fulcrum or pivot point C for the slip, as shown in FIG. 3.

Upon pivotal movement of the slip 38 from the retracted position of FIG. 1 to the set position of FIG. 4, the concentric circles described by the upper end of the slip 38 and of the carrier 26 become eccentric, that is, the center line no longer coincide. Accordingly, and if such movement were unlimited, the pins 36 carried by the slip 38 would move out of the recesses 34. However, the lengths of the base 42 of the recesses 34 are limited so that the pins 36 remain in the recess 34 in the carrier 26. The pins 36 are be located in the slip 38 and relative to the recesses 34 in the slip carrier 26 so that the maximum length of moment arm B is obtained.

When it is desired to release the slip 38, an upward force is exerted on the tubing 16, lifting the setting assembly 14 and moving the shoulder or downwardly facing surface 32 away from the upper end of the slip 38. The recesses 34, which are in the slip carrier 26, move upwardly, forcing the release surface 40 into engagement with the pins 36. It can be seen that the effect of the upward movement results in a force being imposed on the pins 36 in a direction perpendicular to the surface 40 causing the slip 38 to pivot about the pivot point C, or the point of engagement of the teeth 48 with the pipe 12, and pulling the upper teeth 46 out of engagement with the pipe 12, rather than moving the slip almost vertical, and shearing the pipe, as is true in the older releasing mechanisms.

A theoretical equation has been written that describes this force. The equation neglects friction, however it is believed that similar frictional forces occur in both the new and old design. The equation is:

$$F\,REL = F\,SET\,(D/B)\sin A,$$

where;

- F SET is the force with which the slip 38 has been set,
- F REL is the release force exerted on the tubing 16 to unset the slip 38,
- D is the interior diameter of the pipe,
- B is the moment arm previously described,
- Angle A is the angle described by the moment arm relative to the center line 44 of the tool 10, and
- F REA is the reaction or pivotal force that results from the force equation.

The equation for the same slip design, but with the lug type release as previously utilized is:

$$F\,REL = F\,SET\,(D/Y),$$

where:

- Y is the distance from a vertical line projecting through the release lug to the lower teeth pivot or fulcrum point. The remaining factors are as previously described.

The result of comparing the equations indicates that the force required with the release apparatus described in this application is much less than that previously required utilizing the lug release. Indeed, this has been borne out by tests run in the laboratory.

Tests were run on a 9⅝" packer having the unitary slips described hereinbefore. A pressure of 3,000 psi was applied below the tool to set the slip in the pipe. The release mechanism currently in use, that is, the lug release mechanism, required 81,000 pounds of force to release when 3,000 psi was applied below the slip. Comparatively, the release apparatus of this invention, operating under the same pressure required only 38,000 pounds of force to release the slip. The reduced force represents a reduction of 53%. Thus, it is apparent that the new design does offer a tremendous advantage over the lug type slip release currently in use.

From the foregoing detailed description, it should be apparent that slip release apparatus constructed in accordance with this invention is simple in structure, requires little or no maintenance, and substantially reduces the forces required to release the slip after it has been set.

Having described but a single embodiment of the invention, it should be apparent that many changes and modifications can be made thereto without departing from the spirit or scope of the invention.

What is claimed is:

1. An improved slip releasing apparatus for packers and the like useful in pipes, well bores and the like comprising:

a unitary slip member pivotal between set and unset positions, said slip member being of generally cylindrical configuration and including wall engaging teeth on an outer surface thereon, said teeth being located on generally diagonally opposite portions of upper and lower ends, respectively;

diametrically opposed releasing pins mounted in said slip member adjacent to said upper end and projecting inwardly therefrom; and, an elongated tubular slip carrier member extending through said slip member and being moveable relative thereto, said carrier member having a pair of releasing recesses located therein for receiving said pins, said recesses forming releasing surfaces in said carrier member engaging said pins which said carrier member is moved in a direction to move said slip member toward the unset position.

2. The slip releasing apparatus of claim 1 wherein:

the teeth on the lower end of said slip member provide a fulcrum about which said slip member pivots when in engagement with the pipe or well bore wall; and, said releasing pins are located in said slip member to define a release moment arm of maximum length from said fulcrum generally toward the other teeth while permitting engagement of said pins with said carrier member in said recesses in all positions of said slip member.

3. The apparatus of claim 2 wherein:

a release angle is defined by the intersection of the longitudinal axis of said carrier member and a line extending through said fulcrum and through the mid-point between said releasing pins; and, wherein said release angle is determined by the transverse size of said recesses necessary to permit said slip member to pivot between said positions while maintaining said release pins in said recesses.

4. The apparatus of claim 1 wherein:

the teeth on the lower end said slip member provide a fulcrum about which said slip member pivots when in engagement with the pipe or well bore wall;

a release angle is defined by the intersection of the longitudinal axis of said carrier member and a line extending through said fulcrum and through the mid-point between said releasing pins; and, wherein said release angle is determined by the transverse size of said recesses necessary to permit said slip member to pivot between said positions while maintaining said release pins in said recesses.

5. The slip releasing apparatus of claim 1 wherein said recesses in said carrier member are generally right triangles with the hypotenuse of said triangles forming said releasing surfaces.

6. The slip releasing apparatus of claim 5 wherein said hypotenuse is disposed at an angle relative to the longitudinal axis of said carrier and the sides of said recesses adjacent to the teeth on the lower end of said slip being substantially parallel to said longitudinal axis.

7. The slip releasing apparatus of claim 6 wherein said hypotenuse traverses the longitudinal axis of said carrier member.

* * * * *